United States Patent [19]

Brunius

[11] Patent Number: 4,855,713

[45] Date of Patent: Aug. 8, 1989

[54] LEARN MODE TRANSMITTER

[75] Inventor: Robert E. Brunius, St. Paul, Minn.

[73] Assignee: Interactive Technologies, Inc., St. Paul, Minn.

[21] Appl. No.: 254,578

[22] Filed: Oct. 7, 1988

[51] Int. Cl.[4] ..... G08B 1/08; G08B 26/00

[52] U.S. Cl. ..... 340/506; 340/539; 340/531

[58] Field of Search ..... 340/506, 539, 505, 518, 340/521, 525, 531–538, 825.22, 825.27, 825.34, 825.36, 825.5, 825.44, 825.49, 36 SE; 364/550; 379/37

[56] References Cited

U.S. PATENT DOCUMENTS 4,737,770 4/1988 Brunius et al. ..... 340/506

*Primary Examiner*—Donnie L. Crosland

*Attorney, Agent, or Firm*—Douglas L. Tschida

[57] ABSTRACT

A method and apparatus in a security system whereby a central processing unit self learns the identities of its distributed wireless keypad and alarm transmitters. Each transmitter includes an electrically eraseable memory containing signal conditioning data and a pseudo randomly programmed identification code. During a transmitter initiating programming condition, the CPU captures the received identification code of each transmitter and establishes an identity code table by which subsequently received transmissions are confirmed as belonging to the system.

9 Claims, 8 Drawing Sheets

LEARN MODE TRANSMITTER

BACKGROUND OF THE INVENTION

The present invention relates to security systems and, in particular, to a system including one or more wireless keypad and distributed sensor or alarm transmitters, the identities of which transmitters are self-learned by the central processing unit (CPU) with an initial programming transmission.

Security systems including a plurality of distributed alarm sensors, of necessity, must be capable of distinguishing each sensor from each other sensor. For hardwired systems, physical connections determine the identity of each sensor and dictate the inherent system response to detected alarm conditions. Wireless systems, in contrast, typically transmit with each transmission an identity code. This code is, in turn, decoded along with the alarm message by the CPU or central station as it responds to each received transmission.

An example of one such system can be found in applicant's U.S. Pat. No. 4,737,770 which discloses a system wherein the transmitter portion of each distributed wireless alarm sensor includes a programmable register which stores an installer-entered identification code. The code includes a "house code" or system defining portion and a "sensor number" defining the type of alarm sensor and zone protected within the system.

Otherwise, a variety of other predecessor systems have included DIP switches and other physically programmable devices which require installer intervention to make or break certain hardwired connections. Some systems have also included factory programmed memories.

Of necessity, however, the foregoing systems require the installer to manually maintain a record of the identities assigned to each sensor which must be individually, manually programmed into each sensor and into the system's CPU. Where the code is factory entered into the transmitter, the installer must still separately program each alarm sensor code into the CPU. Each code must further be confirmed after installation.

This programming process has been facilitated by way of Applicant's pending U.S. Pat. application Ser. No. 07/156,547, filed Feb. 16, 1988 and entitled Micro-Programming Security System. This system utilizes the programmable sensor transmitters of the U.S. Pat. No. 4,737,770 patent. Although, the sensor transmitters require manual programming in the field, the CPU is operable to self-identify its distributed sensors with the first transmission from each. Specifically, the CPU upon detecting a "house code" comparable to its own confirms whether the subsequently received identification code or sensor number has been programmed into a portion of RAM where predefined system data is loaded from ROM upon initialization. If not, the CPU flags the corresponding memory location in RAM and thereafter knows the identity of each of its reporting wireless sensors.

Although the foregoing CPU is capable of learning its sensors by flagging predefined sensor numbers, an installer may inadvertently still mis-program one or more sensor identification numbers. While relatively easily detected for systems with relatively few distributed sensors, for larger commercial installations, it becomes much more difficult and time-consuming to detect errors.

Accordingly, a need exists for an apparatus and a methodology whereby the human element can be removed from the process of defining and setting sensor identity codes at the keypad, each alarm transmitter and the CPU. This will not do away with the installer though, since he/she need always insure the proper installation and operation of the alarm detecting transducers associated with each sensor transmitter, among the other tasks normally performed by such personnel.

SUMMARY OF THE INVENTION

It is accordingly a primary object of the present invention to provide for a security system wherein each alarm sensor is pseudo-randomly programmed with an identification number at the time of manufacture.

It is a further object of the invention to provide a system CPU having the capability of "self-learning" each of its assigned, distributed key pad and alarm transmitters, upon receiving an initial transmission.

It is a further object of the invention to provide an integrated circuit transmitter construction including an electrically programmable identification code storage means which circuit is adaptable to key pad or alarm use, means for pseudo-randomly programming such storage means and a CPU including means responsively decoding received transmissions and writing the identity code of each transmitter into an ID code table as it is first received and confirming each received identity against the self-learned identity store during subsequent transmissions.

Various of the foregoing objects, advantages and distinctions of the invention are particularly achieved in the presently preferred embodiment which comprises a pair of modular, integrated transmitter circuits, each of which include an electrically erasable read only memory (EEROM) for storing a transmitter identification code, a device type code and signal conditioning parameters. The keypad transmitter circuit is used in a wireless keypad accessible to the system user and the other circuit is used in each permanently mounted transmitter associated with the system's wireless alarm transducers.

Each transmitter's code is randomly programmed at the factory from an essentially infinite pool of numbers which code is thereafter transmitted with each transmission.

Otherwise, the CPU, during system initialization, upon hearing each transmitter's identity code for the first time writes the code into a storage location in its memory which is thereafter accessed prior to responding to any later received transmissions. This initialization normally occurs during system programming when the CPU is placed in its program mode. The installer then induces a tamper transmission or other special condition at each transmitter which induces a corresponding alarm transmission, including the transmitter's identity code. The CPU, upon confirming the pre-conditions of a program mode and tamper or special alarm, responsively writes the received identity code into its own local identity code table in random access memory (RAM). Once returned to a normal, armed operating mode and so long as a received message includes one of the self-learned identity codes, the CPU will respond.

The foregoing objects, advantages and distinctions of the invention, among others, as well as a detailed description of its construction and operation follow with respect to the appended drawings. Before referring thereto, it is to be understood the following description is illustrative of one form only of the invention which might be embodied in a number of other constructions to provide comparable results. Accordingly, the description should not be interpreted in limitation of the spirit and scope of the invention claimed hereinafter. To the extent modifications and/or improvements have been considered, they are described as appropriate.

DESCRIPTION OF THE PREFERRED EMBODIMENT

Figure 1A:
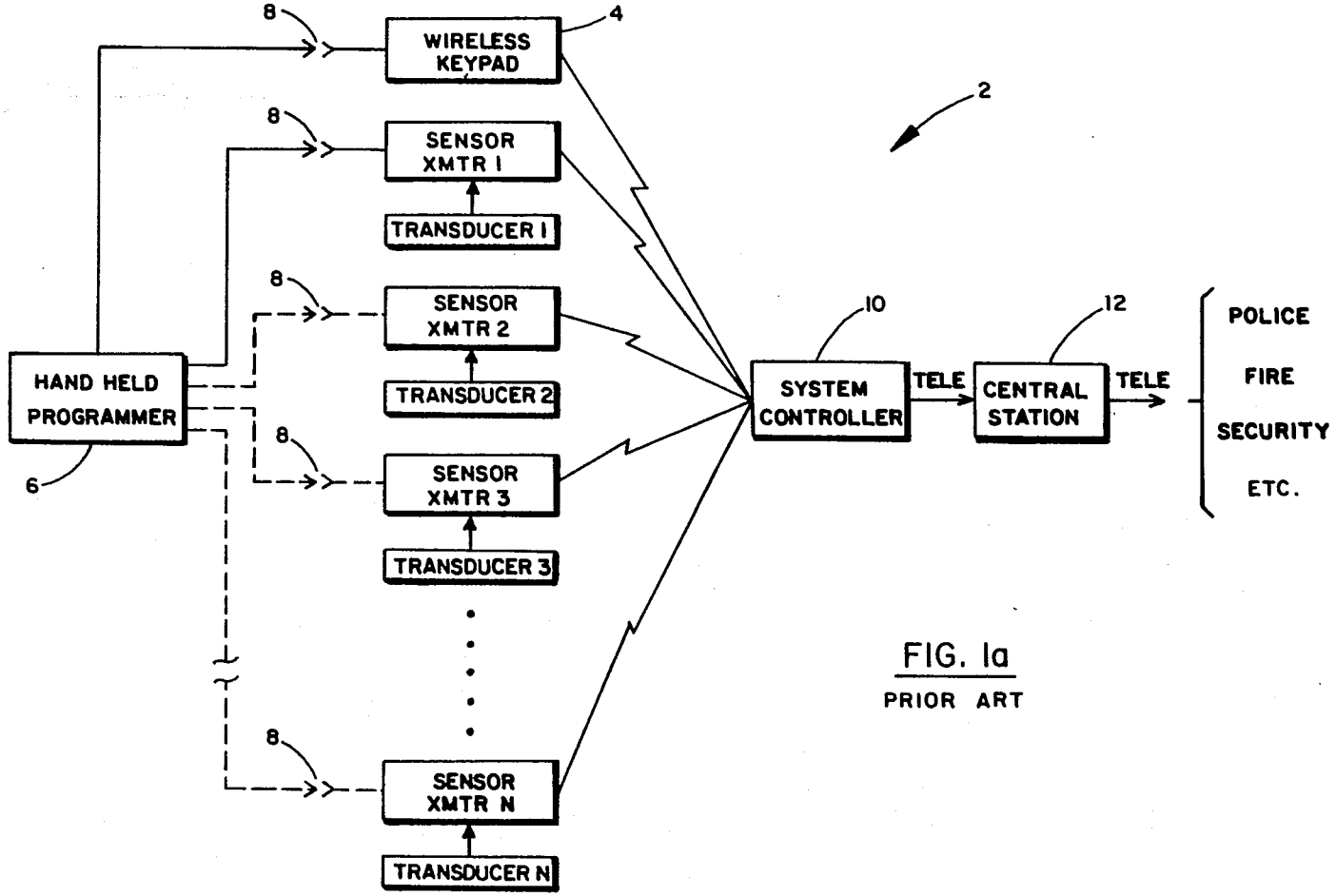
FIG. 1a PRIOR ART
FIG. 1*a* shows a generalized block diagram of a prior art system.

Referring to FIG. 1*a*, a block diagram is shown of a typical prior art system 2 using Applicant's sensor transmitter disclosed in U.S. Pat. No. 4,737,770. Generally, the sensor transmitters 1 to N and wireless keypad 4 of this system are programmable by way of a handheld programmer 6 which is individually coupled to each of the sensor transmitters via hardwired connectors 8 during system installation. A system or "house code" and a sensor number or zone identity code, along with signal preconditioning parameters peculiar to the type of associated transducer, are particularly programmed into each sensor transmitter 1 to N and wireless keypad 4 during programming to establish the subsequent operation of each to detected alarms. The system controller 10 is separately programmable with corresponding data via the hand-held programmer 6.

The sensor transmitters of Applicant's pending application Ser. No. 07/156,547 are also similarly programmable. The system controller 10 of the latter application, however, includes a feature whereby the controller 10, as it receives an initial transmission from each sensor transmitter or keypad 4 having a similar "house code", during a programming mode, flags one of a possible number of predefined storage locations within an internal RAM memory, if not previously flagged. Thereafter, during normal operation, upon confirming the presence of a flagged sensor member and house code, the CPU appropriately responds to any received transmission including one of its self-learned transmitter identification codes.

Figure 1B:
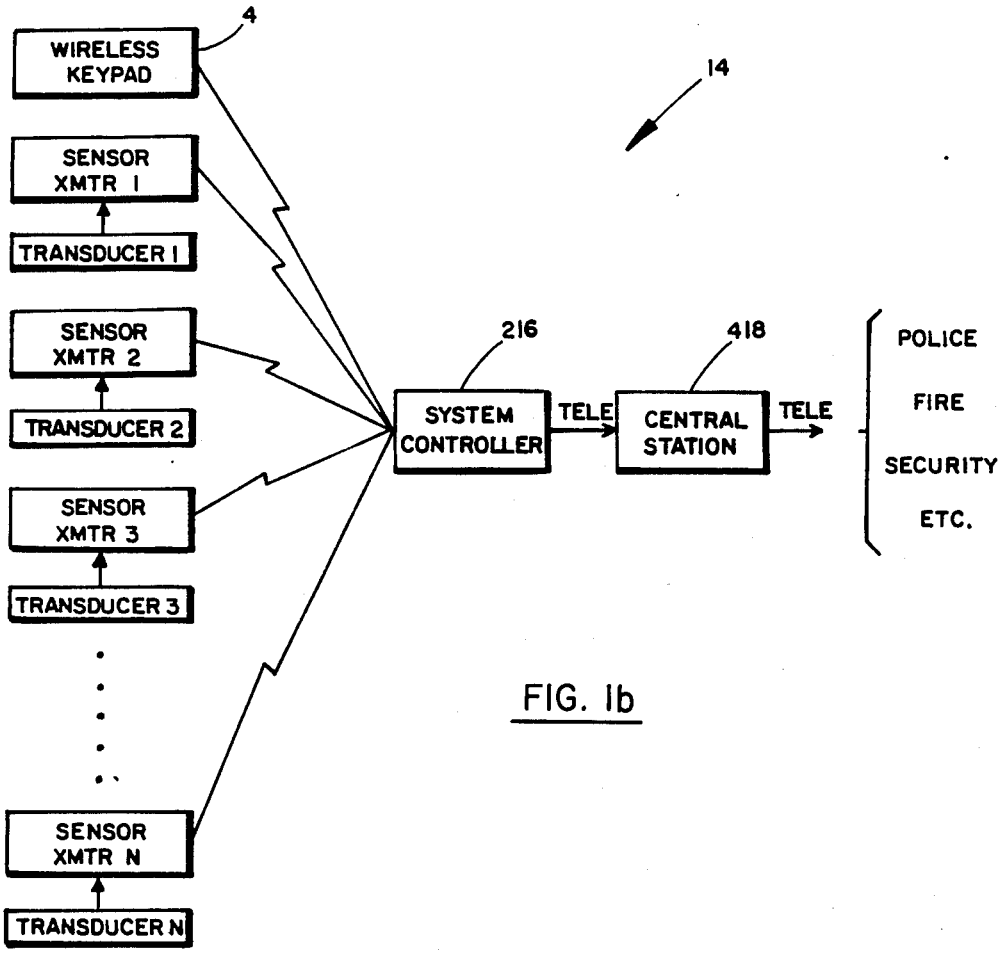
FIG. 1*b* shows a generalized block diagram of a security system including the present invention.

The presently improved system 14 of FIG. 1*b*, in contrast to the system 2 of FIG. 1*a* does away with the necessity of a dedicated, handheld programmer 6 and/or a dedicated programmer (not shown) within its system controller 16. Instead, each sensor and keypad transmitter of this system is factory programmed with a pseudo randomly selected one of a pseudo-infinite number of identity codes. That is, during the final test of the integrated circuits used in the sensor transmitters 1 to N, associated test circuitry, such as the integrated circuit carrier, is programmed to randomly, incrementally load a unique identity code into each transmitter circuit, prior to leaving the factory.

Thereafter during system installation, each of the sensor transmitters 1 to N and keypads 4 to be installed in a particular system are programmed into the system controller 2 without the necessity of the installer remembering identity codes. This occurs by placing the controller 16 in its program mode and individually violating a tamper switch at the enclosure of each sensor and keypad transmitter to produce a corresponding alarm. Alternatively, various other special transmitter conditions can be established which must occur in concert with the programming mode. Upon receiving each tamper alarm transmission, the controller 16 writes the received identity code into an internal RAM store or identity code table. Thereafter, the controller 16 responds only to received transmissions containing one of its learned identity codes.

The happenstance situation of two sensor transmitters having the same identity code is also infinitely remote given that at least $2^{20}$ permutations exist. If it did happen, however, a different transmitter would be substituted for the duplicate.

Otherwise, after each transmitter's identity code is entered into the controller 16, the controller 16 may be appropriately activated to scroll back the codes of its programmed transmitters. The installer is thereby able to confirm proper programming.

Once the controller 16 has been programmed and the identities of its sensor transmitters have been confirmed, the controller 2 is switched out of its programming mode and appropriately armed to a desired level. Thereafter, upon detecting either a tamper or an alarm transmission from any of its sensor or keypad transmitters, the controller 16 appropriately responds, depending upon the specific sensor tripped and the programmed arming level as per pre-programmed responses stored in the controller's response ROM and as described in Applicant's pending 07/156,547 application.

Figure 2:
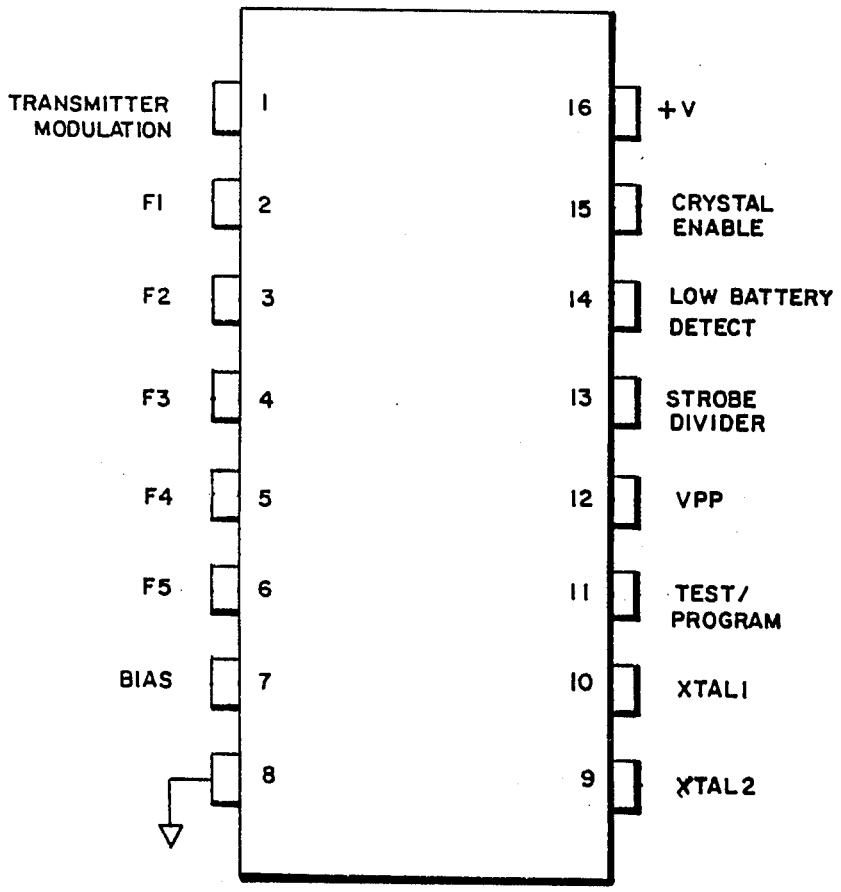
FIG. 2 shows an input/output diagram of one of the integrated sensor transmitter circuits.
Figure 3:
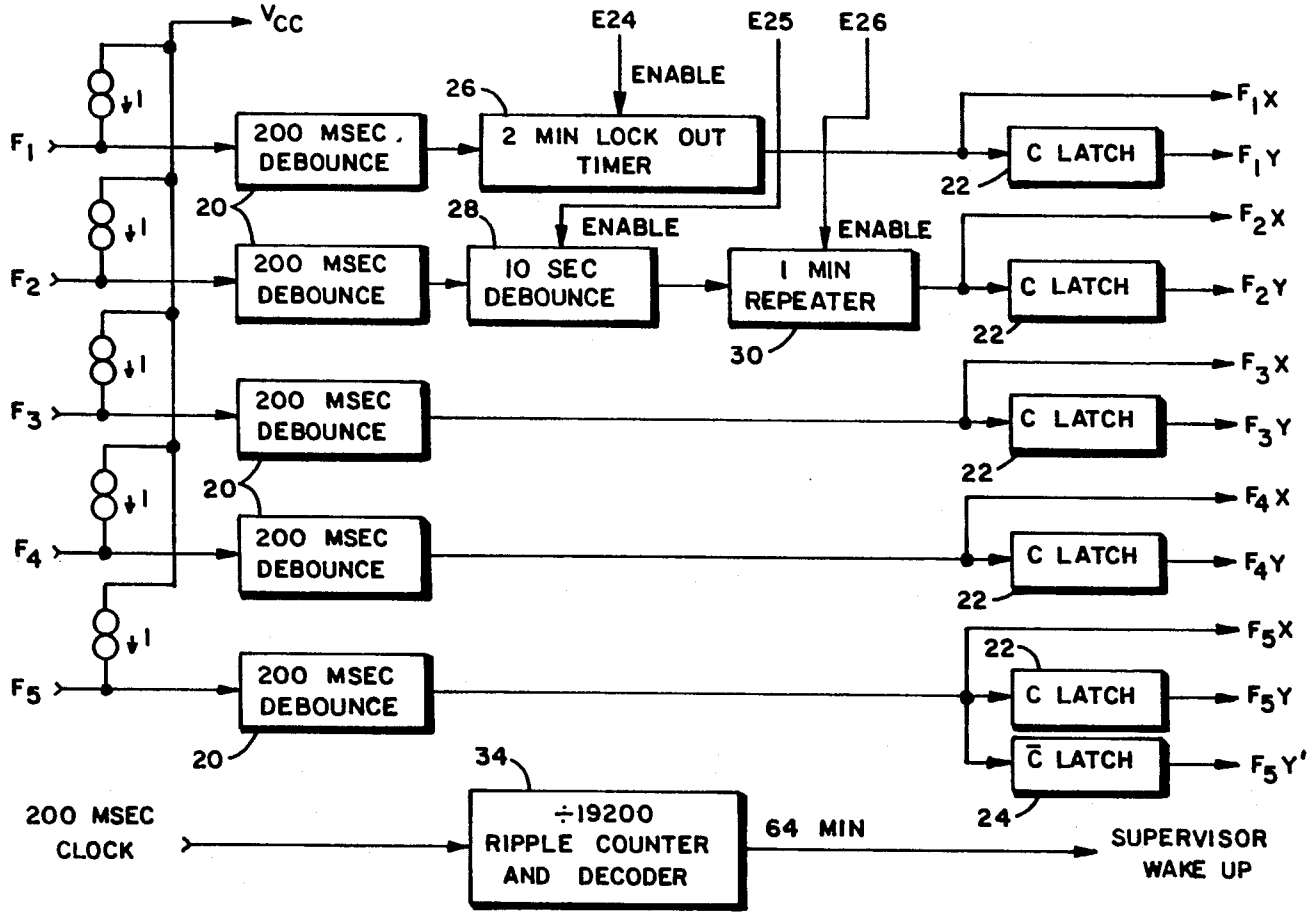
FIG. 3 shows a diagram of the input signal processing circuitry contained in the integrated circuit of FIG. 2.
Figure 4:
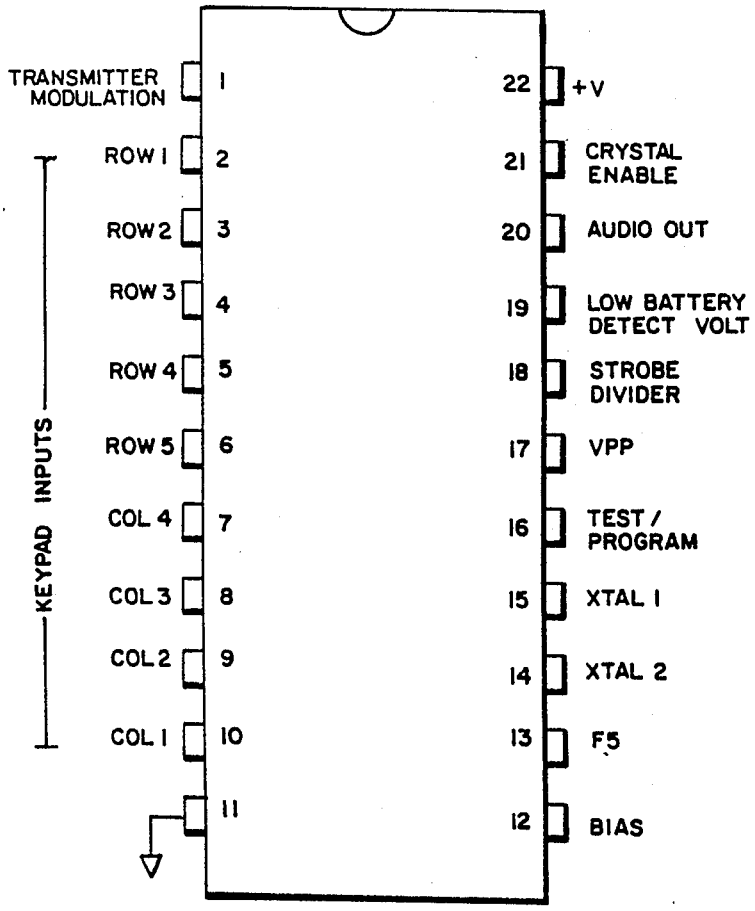
FIG. 4 shows an input/output diagram of the wireless keypad integrated circuit.

Referring to FIGS. 2 and 4, diagrams are shown of the various inputs and outputs coupled to each of the integrated circuit transmitters of the present invention. The circuit of FIG. 2 particularly relates to each sensor transmitter 1 to N and the circuit of FIG. 4 relates to each wireless keypad transmitter 4. Details of the associated peripheral and oscillator circuitry commonly surrounding each of the transmitters of FIGS. 2 and 4 can be found upon directing attention to FIGS. 3 and 4 of Applicant's U.S. Pat. No. 4,737,770. All such circuitry is battery powered and packaged in as small a package as possible for inconspicuous mounting.

With the exception of the inputs of F1 to F5 for the sensor transmitter of FIG. 2 and the row 1 to 4 and column 1 to 4 inputs of the circuit of FIG. 4, each of the circuits of FIGS. 2 and 4 is similarly constructed and includes essentially equivalent adjunct circuitry. That is, each provides for a power (+V) input, a ground input, a test/program select input, a programming voltage input (VPP), a bias input for establishing the bias of internal circuitry, a low battery detect input for enabling a reference voltage output indicative of the condition of the storage battery used with the transmitter and a strobe divider output used to enable an external voltage divider for the reference voltage established from the low battery detect input. Otherwise, a pair of inputs XTAL1 and XTAL2 couple to an external 32.7 MHZ crystal oscillator which provides necessary circuit timing.

Lastly, each transmitter's transmitter modulation and crystal enable outputs control the coupling of each transmitter's digital data to an associated RF oscillator for transmission to the controller 16. The transmitter of FIG. 4 additionally includes an audio output for providing a 50 msec beep at 2048 Hz with each depression of one of the wireless keypad keys. An output alarm input labeled F5 is also provided with internal latches for storing the positive and negative signal edges. This input is used during programming and otherwise is used as the "tamper" input from the tamper reed switch at the transmitter's enclosure.

Also included internally of each of the transmitters of FIGS. 2 and 4 are 27 bits of electrically erasable read only memory (EEROM) which is programmable at the factory. Of the provided storage, twenty bits define a transmitter identification code, 4 bits define a device type code (i.e. keypad or alarm) and 3 bits define various signal conditioning parameters.

Of the signal conditioning bits, one bit enables a two minute lock out timer on the input channel F1, one a 10 second debounce timer on input channel F2 and the third, a one minute repeater on input channel F2. The repeater function is particularly useful upon the detection of a smoke alarm input, which if it has existed for more than one minute, induces a re-transmission of the alarm so long as it remains set (low).

In the latter regard and turning attention to FIG. 3, a block diagram is shown of the input circuitry in the transmitter of FIG. 2. This circuitry responds to the alarm inputs for each of the transducers 1 to N. That is, five input ports F1 to F5 are provided which define the alarm state of up to five transducers such as might typically be coupled to a single sensor transmitter, for example, five window switches; although the F5 input is normally assigned to the enclosure tamper switch.

In the event of the receipt of an input on any one of these ports, associated 200 msec debounce circuitry 20 filters each input before coupling the input to six available output latches 22. The debounce circuitry 20 particularly requires that two consecutive samples, each taken 200 msec apart and during a 1 msec sample period, be identical. For the F3 and F4 ports, once debounced, each input produces a pair of outputs F3X, F3Y and F4X, F4Y. The X output reflects the current state at the input port and the Y output reflects the previous state of the input port or the latch state. If during an alarm transmission the X output changes state, an associated message repetition counter is cleared and the latest state is transmitted. Thus, the most current state is transmitted a full complement of times.

A complementary latch 24 is provided at the F5 output which reflects the positive and negative edge of the input. Three outputs are thus produced in response to a state change at the input port F5.

Coupled intermediate the debounce circuitry 20 and the outputs F1X, F1Y and F2X, F2Y at the input ports F1 and F2 are a two minute lock out timer 26, a ten second debounce timer 28, and a one minute repeater circuit 30. This circuitry is responsive to the above-mentioned signal preconditioning bits and operates as follows. If the two minute lock out bit is set, the timer 26 requires a non-cumulative restoral of the F1 input for two minutes before the input is passed to the output. If not set, the F1 input is immediately passed to the output.

If the ten second debounce timer 28 bit is enabled, then 63 consecutive samples of the F2 input must be high before the input can be coupled to the F2X, F2Y output. Consequently an extended debounce time of 8.8 seconds is provided upon enabling this bit and which is most commonly used for smoke detector transducers to prevent alarm transmissions where a low battery at the sensor is inducing the alarm state changes.

Lastly, if the one minute repeater bit is set, the transmitter will reactivate every minute so long as the F2 input has remained in alarm. Again this function is provided for smoke detector transducers to assure the re-transmission of an alarm state so long as the alarm is present.

A 5 msec clock 34 is also provided to produce a supervisory transmission once every 64 minutes or whenever one of the five debounced inputs F1 to F5 changes state or when the smoke detector repeater activates.

Once enabled, each sensor or alarm transmitter transmits eight identical message packets of 58 bits each with each packet being separated from the preceding message by a semi-random delay varying from 125 msec to 484 msec. The specific inter-message time delay is determined from the output of a two stage counter 32 contained on each chip and shown in FIG. 5. The counter 32 is enabled from the crystal enable output and clocked at the 32 Khz crystal rate to produce a 4 bit, first stage variable output which is coupled to a second 5 bit down counter stage having appropriately hard-wired inputs that establishes the specific inter-message time. Essentially therefore a 2 counter divider is provided with the second counter operating at 15.625 msec clock rate.

Of the 58 bits transmitted with each message, Table 1 below shows the meanings attributed to each bit.

TABLE I

ALARM DATA

| Bit Position | Description |
|---|---|
| B0–B14 | Logic 0 Synchronization |
| B15 | Logic 1 Start |
| B16–B42 | EEROM bits E0 → E26 |
| B43 | Low battery detector status. Logic 0=OK |
| B44 | Input f1 state |
| B45 | Input f1 +latch state |
| B46 | Input f2 state |
| B47 | Input f2 +latch state |
| B48 | Input f3 state |
| B49 | Input f3 +latch state |
| B50 | Input f4 state |
| B51 | Input f4 +latch state |
| B52 | Input f5 state |
| B53 | Input f5 +latch state |
| B54 | Input f5 −latch state |
| B55 | Even parity over the odd bits B1→B53 |
| B56 | Odd parity over the even bits B0→B54 |
| B57 | Odd parity over all bits B0→B56 |

Generally though each message is segregated into 16 start bits, 39 data bits, and 3 error detection bits. Of the data bits, 20 constitute each transmitter's identification code, four bits identify the sensor type, three bits define the input signal conditioning information, five bits define the current state of the input ports, six bits define the previous state of the input ports and one bit defines the low battery detector status.

Figure 5:
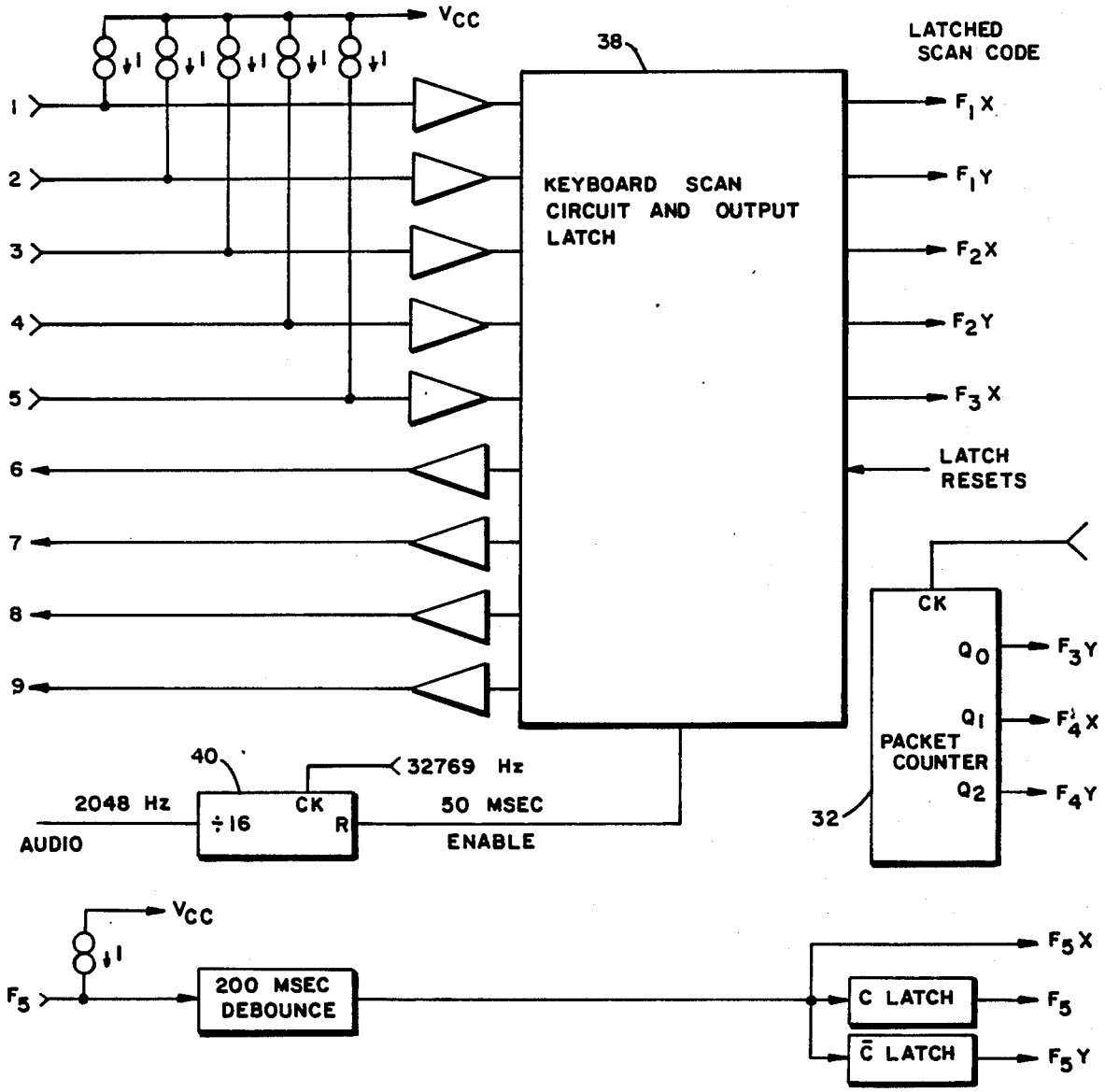
FIG. 5 shows a diagram of the input signal processing circuitry contained in the integrated circuit of FIG. 4.

Turning attention next to FIG. 5, a block diagram is shown of the input circuitry of the keypad transmitter of FIG. 4. This circuitry includes keyscan circuitry 38 for continuously monitoring the rows and columns of the keyboard inputs to determine valid entries. Such entries are determined by sequentially scanning each column, relative to changes in the logic condition of any one of the row inputs. A valid entry is assumed if the logic state of only one row input changes and only one of the four columns produces a row activation signal.

The possible valid keypad entries are shown below in Table 2. No keypad entry is accepted until 100 msec after the transmission of a previously entered key value is completed. In the event of multiple key depressions, the first entered value is decoded although not accepted.

TABLE II

KEYPAD TRUTH TABLE

| Key | Row | | | | | Column | | | | Packet Output Bits | | | | | |
|---|---|---|---|---|---|---|---|---|---|---|---|---|---|---|---|
| Label | 1 | 2 | 3 | 4 | 5 | 1 | 2 | 3 | 4 | B44 | B45 | B46 | B47 | B48 | In Hex |
| No Key | 1 | 1 | 1 | 1 | 1 | 0 | 0 | 0 | 0 | 1 | 1 | 1 | 1 | 1 | F 1 |
| 1 | 0 | 1 | 1 | 1 | 1 | 0 | 1 | 1 | 1 | 1 | 0 | 0 | 0 | 0 | 1 0 |
| 2 | 0 | 1 | 1 | 1 | 1 | 1 | 0 | 1 | 1 | 0 | 1 | 0 | 0 | 0 | 2 0 |
| 3 | 0 | 1 | 1 | 1 | 1 | 1 | 1 | 0 | 1 | 1 | 1 | 0 | 0 | 0 | 3 0 |
| Spare | 0 | 1 | 1 | 1 | 1 | 1 | 1 | 1 | 0 | 1 | 1 | 0 | 1 | 1 | A 1 |
| 4 | 1 | 0 | 1 | 1 | 1 | 0 | 1 | 1 | 1 | 0 | 0 | 1 | 0 | 0 | 4 0 |
| 5 | 1 | 0 | 1 | 1 | 1 | 1 | 0 | 1 | 1 | 1 | 0 | 1 | 0 | 0 | 5 0 |
| 6 | 1 | 0 | 1 | 1 | 1 | 1 | 1 | 0 | 1 | 0 | 1 | 1 | 0 | 0 | 6 0 |
| Spare | 1 | 0 | 1 | 1 | 1 | 1 | 1 | 1 | 0 | 1 | 1 | 0 | 1 | 1 | B 1 |
| 7 | 1 | 1 | 0 | 1 | 1 | 0 | 1 | 1 | 1 | 1 | 1 | 1 | 0 | 0 | 7 0 |
| 8 | 1 | 1 | 0 | 1 | 1 | 1 | 0 | 1 | 1 | 0 | 0 | 0 | 1 | 0 | 8 0 |
| 9 | 1 | 1 | 0 | 1 | 1 | 1 | 1 | 0 | 1 | 1 | 0 | 0 | 1 | 0 | 9 0 |
| Spare | 1 | 1 | 0 | 1 | 1 | 1 | 1 | 1 | 0 | 0 | 0 | 1 | 1 | 1 | C 1 |
| Status | 1 | 1 | 1 | 0 | 1 | 0 | 1 | 1 | 1 | 0 | 1 | 1 | 1 | 1 | E 1 |
| 0 | 1 | 1 | 1 | 0 | 1 | 1 | 0 | 1 | 1 | 0 | 0 | 0 | 0 | 0 | 0 0 |
| Bypass | 1 | 1 | 1 | 0 | 1 | 1 | 1 | 0 | 1 | 0 | 0 | 0 | 0 | 1 | 0 1 |
| Spare | 1 | 1 | 1 | 0 | 1 | 1 | 1 | 1 | 0 | 1 | 0 | 1 | 1 | 1 | D 1 |
| Police | 1 | 1 | 1 | 1 | 0 | 0 | 1 | 1 | 1 | 1 | 0 | 0 | 0 | 1 | 1 1 |
| Fire | 1 | 1 | 1 | 1 | 0 | 1 | 0 | 1 | 1 | 0 | 1 | 0 | 0 | 1 | 2 1 |
| Medical | 1 | 1 | 1 | 1 | 0 | 1 | 1 | 0 | 1 | 0 | 0 | 1 | 0 | 1 | 4 1 |
| Aux | 1 | 1 | 1 | 1 | 0 | 1 | 1 | 1 | 0 | 0 | 0 | 0 | 1 | 1 | 8 1 |
| Any Multiple (more than one row or column) | → | → | → | → | → | → | → | → | → | 1 | 1 | 1 | 1 | 1 | F 1 |

The keypad transmitter, like the alarm transmitter, transmits a 58 bit message packet which is preceded by a 2 msec crystal enable signal and is followed by a ten clock cycle stop, along with a 100 msec intermessage time delay. Table 3 sets forth the meanings assigned to each of the 58 keypad data bits, but which meanings are substantially the same as in Table 1 for the sensor transmitters.

TABLE III

KEYPAD DATA

| Bit Position | Description |
|---|---|
| B0–B14 | Synchronization (forced logic ZERO) |
| B15 | Start bit (forced logic ONE) |
| B16–B42 | EEROM bits E0 to E26 |
| B43 | Battery Status (ONE=low bat, ZERO=bat OK) |
| B44–B48 | Keypad switch value (all 1's code is no key down) |
| B49–B51 | Message packet counter |
| B52 | Input F5 state |
| B43 | Input F5 + F5 latch state |
| B54 | Input F5 − F5 latch state |
| B55 | Even parity over odd bits B1–B53 |
| B56 | Odd parity over even bits B0–B54 |
| B57 | Odd parity over all bits B0–B56 |

Included also in each transmitted packet is the 3 bit packet count value established by the message packet counter 32. As with the sensor transmitter, eight transmissions are produced for each key entry and/or a supervisory developed by the supervisory timer or a state change at the F5 input. Similarly, the keypad transmitter includes low battery monitoring circuitry and an inter-message time delay counter.

A clock 40 produces the audio output which drives a speaker (not shown) used to annunciate each key depression.

Figure 6:
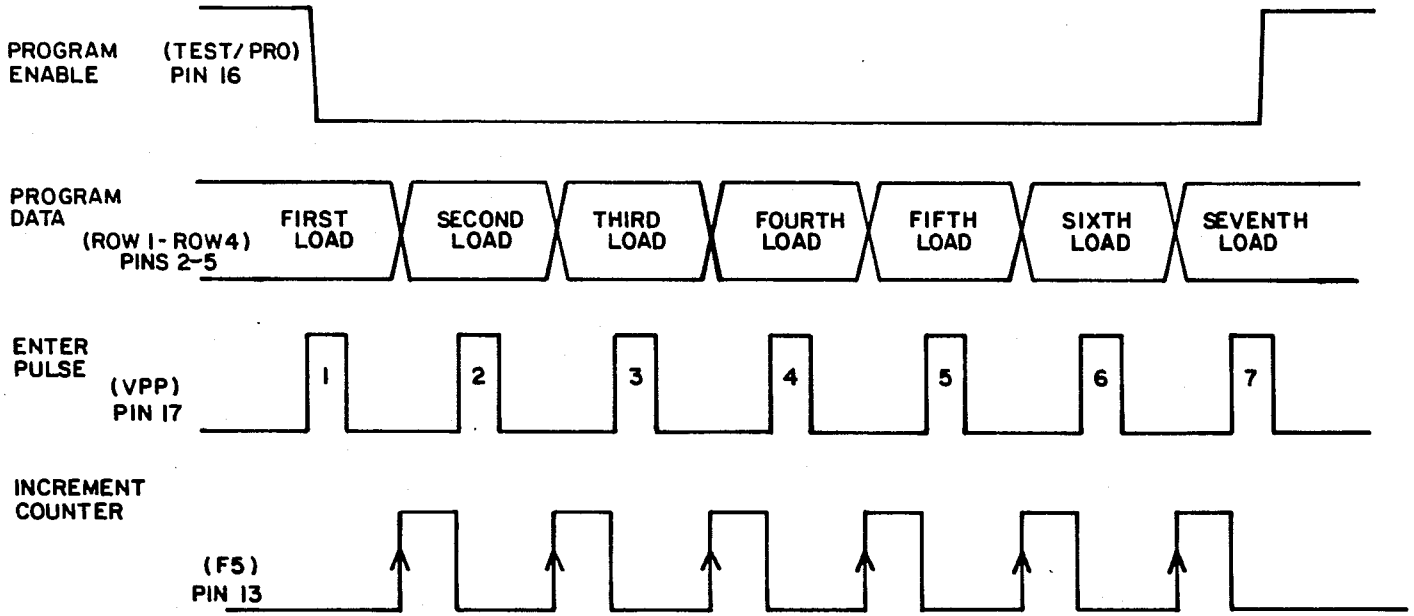
FIG. 6 shows a timing diagram of the manner in which the integrated transmitters of FIGS. 2 and 4 are pseudo-randomly programmed.

Turning attention next to FIG. 6, a timing diagram is shown of the identity code programming operation performed when programming each of the sensor and keypad transmitters of FIGS. 2 and 4. The programming or writing of the 27 EEROM bits of each transmitter is performed in six or seven sequential groups of four bits each. First, however, each transmitter is switched to its program mode by coupling a logic low to the test/program input for the duration of the programming operation. Each of the various groups of data are, in turn, successively coupled to the row 1 to 4 or F1 to F4 input ports. Upon the occurrence of each of a series of 22 volt enter pulses at the input VPP, each group is written into the identity code table. With each load operation, a block signal at the F5 input, in turn, increments a "load word" counter (not shown). Once all of the bits of each 27 bit word are loaded, an overflow occurs at the load word counter and the programming operation is disabled.

As mentioned, such a programming operation can be performed during the testing of each integrated circuit. At this time each transmitter circuit is normally restrained in a test device having leads coupled to each of the input and output ports. Thus, it is necessary only to implement the foregoing sequence as the desired identification data is made available to the data ports. Presently, the output of a twenty bit counter is used to establish each unique identity code and which counter is incremented with the completion of each test operation. A code value in the range of 1 to $2^{20}$ is thus written into each transmitter which essentially comprises a pseudo random code. Greater permutations are also possible by assigning others of the data bits of each packet to this purpose.

For purposes of inventory control, such a code permits only a remote likelihood of an installer encountering two transmitters having the same identity code. Again, however, on the offchance this should occur, the installer would switch out the duplicate transmitter.

Figure 7:
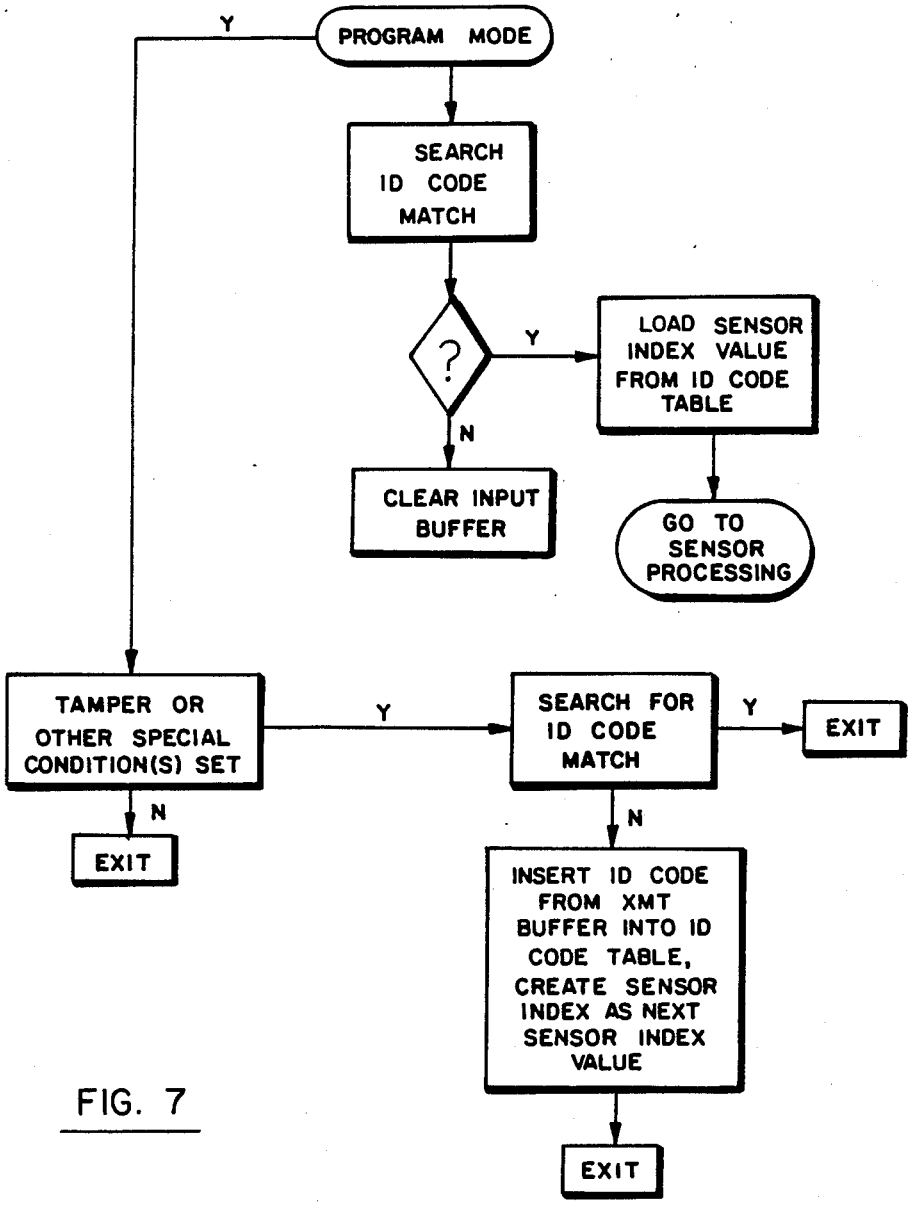
FIG. 7 shows a block diagram flow chart of the manner in which the CPU self-learns each transmitter's identification code and responds to each received transmission.

With attention lastly directed to FIG. 7, a flow diagram is shown of the sequence of steps performed by the microprocessor contained within the system controller's 16 CPU as it self-learns the transmitters assigned to itself. Where a house code previously identified to which system a transmitter belonged, this code is no longer programmed into each transmitter. Instead, upon the controller's 16 receipt of each transmission, it temporarily stores the received identity code in a transmit buffer in juxtaposition to the sensed alarm condition. It then confirms its mode status (i.e. program or armed). In the event the CPU is in a program mode and has received a tamper alarm, it couples the identification code to a portion of the CPU's RAM set aside as an identity code table. A write operation is initialized and the code value is written into the code table. At the same time an index value, dependent upon the numbers of transmitters to which a CPU can respond, is assigned. This index value typically requires fewer bits and serves as a pointer to each identity code's location in the code table.

In a similar fashion as each transmitter is initiated during system installation, an artificial tamper alarm is generated to induce the CPU to successively store each transmitter's unique identity code value and establish a related index value. Upon returning to an armed condition, the CPU thereafter merely confirms that a received identity code is contained within its identity code table, prior responding to the detected alarm and relative to which the operation is as described in Applicant's pending application Ser. No. 07/156,547. Although a tamper condition is used to confirm a transmitter's status of belonging to the system, it is to be appreciated one or more other special conditions might similarly be used.

Accordingly, the present invention provides for a security system capable of self learning the identities of each of its sensor and keypad transmitters without the necessity of an installer operated hand-held programmer. The potential for error is thereby minimized.

While the present invention has been described with respect to its presently preferred embodiment, it is to be appreciated still other embodiments might be suggested to those of skill in the art. It is therefore contemplated that the following claims should be interpreted to include all those equivalent embodiments within the spirit and scope thereof.

What is claimed is:

1. A method for programming a local security system controller with the identity of each of a plurality of wireless transmitters to whose transmissions it is to respond, comprising:

(a) programming a unique identity code into each of said wireless transmitters which identity code is transmitted with each transmission;

(b) establishing said system controller in a program mode;

(c) inducing a predetermined transmission from one of said wireless transmitters;

(d) temporarily storing each received identity code as it is received by said system' controller;

(e) upon detecting said program mode and a predetermined alarm condition, comparing each received identity code at said system controller to a code table; and (f) writing the temporarily stored identity code into said code table, if not located.

2. A method as set forth in claim 1 wherein said predetermined transmission comprises a tamper alarm condition at a transmitter enclosure.

3. A method as set forth in claim 1 including the step of defining an index value corresponding to each stored identity code and its location in the code table.

4. A method as set forth in claim 1 wherein each of said plurality of wireless transmitters is constructed to include an electrically programmable read only memory, and including the further step of permanently programming a portion of said read only memory of each transmitter with a pseudo-random identity code as each transmitter is manufactured.

5. A method as set forth in claim 4 wherein said permanent programming comprises the steps of:

(a) coupling the output of an identity counter to a data input of said wireless transmitter;

(b) establishing each transmitter in a program mode; and (c) writing the output of said identity counter into the identity code table of said wireless transmitter.

6. A method as set forth in claim 5 including the further steps of:

(a) partitioning said identity counter output into a plurality of data groups;

(b) individually writing each of the plurality of data groups; and (c) clocking a group counter as each data group is written and terminating said program mode at a predetermined group counter count value.

7. In a security alarm system having a system controller and a plurality of wireless transmitters operative to transmit at radio frequencies a plurality of conditions, apparatus for identifying to said system controller to which received transmissions it is to respond, comprising:

(a) means for permanently storing a unique identity code in each of said plurality of transmitters which is transmitted with each transmitter transmission;

(b) means for temporarily storing each received identity code at said system controller;

(c) means for operating said system controller in a program mode and an armed mode;

(d) means at said system controller for detecting the condition inducing each received transmission; and (e) means at said system controller for comparing a received identity code to a table of codes, upon detecting a program mode and a predetermined one of said plurality of detectable conditions, and writing said temporarily stored identity code into said table if not already present.

8. Apparatus as set forth in claim 7 including means for establishing an unique index value for each identity code stored in said table.

9. Apparatus as set forth in claim 7 wherein during an armed mode said system controller compares each temporarily stored identity code to said identity code table and responds only if a correspondence is detected.

* * * * *